United States Patent [19]

Casey

[11] Patent Number: 4,898,601

[45] Date of Patent: Feb. 6, 1990

[54] DRYCLEANING RESIDUE AFTERCOOKER

[76] Inventor: Michael E. Casey, 655 Palo Alto Ave., Mountain View, Calif. 94041

[21] Appl. No.: 361,742

[22] Filed: Jun. 1, 1989

Related U.S. Application Data

[63] Continuation of Ser. No. 215,076, Jul. 5, 1988, abandoned, which is a continuation of Ser. No. 800,506, Nov. 21, 1985, abandoned.

[51] Int. Cl.[4] ..... B01D 46/02; B01D 53/04

[52] U.S. Cl. ..... 55/341 R; 55/74; 55/387; 134/12; 202/182; 203/41

[58] Field of Search ..... 55/59, 74, 97, 241 R, 55/361, 387; 134/12; 202/170, 182; 203/41, 49

[56] References Cited

U.S. PATENT DOCUMENTS

| | | | |
|---|---|---|---|
| 2,860,088 | 11/1958 | Plassmeyer | 202/170 |
| 3,132,079 | 5/1964 | Epperly et al. | 203/41 |
| 3,332,854 | 7/1967 | Duckstein | 202/170 |
| 3,434,881 | 3/1969 | Smith | 134/12 X |
| 3,565,767 | 2/1971 | Light | 203/49 X |
| 4,210,494 | 1/1980 | Rhodes | 203/49 X |
| 4,443,269 | 4/1984 | Capella et al. | 134/12 |
| 4,534,830 | 8/1985 | Pastor | 203/86 |

*Primary Examiner*—Charles Hart
*Attorney, Agent, or Firm*—Irell & Manella

[57] ABSTRACT

An aftercooker device for reducing the solvent content of drycleaning solid residues is disclosed as is its application in dry cleaning processes. The aftercooker is adapted for use with fouled disposable filters as well as with the solids which result from the flashing of soil-containing filter backwash. The aftercooker and its use are characterized by the use of ambient to moderately elevated temperatures and low velocity flows of air to remove solvent from residues and to the use of a vent scrubber to recover the solvent so removed.

8 Claims, 1 Drawing Sheet

DRYCLEANING RESIDUE AFTERCOOKER

This application is a continuation of application Ser. No. 07/215,076, filed July 5, 1988 which is a continuation of Ser. No. 06/800,506 filed Nov. 21, 1985 and both now abandoned.

BACKGROUND OF THE INVENTION

1. Field of the Invention

This invention is in the field of dry cleaning solvent recovery. More particularly, this invention relates to a device and process for recovering dry cleaning solvent while minimizing losses of solvent to waste and/or release of solvents to the environment.

2. Prior Art

Dry cleaning processes employ halohydrocarbon liquids such as perchloroethylene, tetrachloroethylene, trichlorofluoromethane, trichlorofluoroethylene or the like to remove a mixture of fatty acids, oils, oil-soluble and insoluble dirt and soil, water and body moisture, and water-soluble dirt and soil from garments and other fabric products. Commonly, the garment or other fabric is contacted with the halohydorcarbon solvent with agitation and the soiled solvent is continuously passed through a filter to isolate the various contaminants picked up by the solvent and return clean solvent to the contacting zone.

Two filtration processes are widely employed. One process uses fabric bag filters coated with filter aids such as diatomaceous earth, carbon black, surfactants, and the like, through which the soiled solvent is passed. The other common process employs disposable filter cartridges having paper or fiber filter elements and carbon.

With either filtration process, the pressure drop across the filter is monitored and when the pressure drop rises to a critical level, the filter is cleaned. This is carried out in the case of filter bags by backwashing and in the case of cartidges by replacement.

The filter bag backwash liquid contains substantial amounts of solvent and is commonly flashed to recover a substantial fraction of the solvent. Nevertheless, the solid residue which results from the flash of the backwash liquid often contains 40%, 50%, 60% or more of solvent. Similarly, the discarded filter cartridges contain large proportions of solvent.

Simple disposal of the solvent-laden residue or filters is not attractive. One problem is that the solvent is expensive and its regular discard in multigallon quantities can add up to a large cost. A more pressing problem is that halohydrocarbon cleaning solvent is considered environmentally hazardous, and its release into the atmosphere or into dump sites is being increasingly regulated. One cannot freely discard such wastes but should treat them as hazardous substances.

Devices have been proposed heretofore for reducing the solvent content of used filters. These devices have been self-contained systems which employ jets of steam to strip out solvent. These devices condense the outflow to give a liquid product. These devices offer the advantage of speed, but are energy and labor intensive and are expensive.

It is an object of this invention to provide a device and method for removing and recovering halohydrocarbon dry cleaning solvent from spent filters or residues which device and method are energy and labor efficient and relatively inexpensive to use and install.

It is a further object to provide a device and method which will reduce the solvent content of spent filters or residues to a level which will permit their disposal as nonhazardous substances—which level is often 1% solvent or less.

STATEMENT OF THE INVENTION

It has now been found that residual solvent is inexpensively and efficiently removed from dry cleaning residues—solids or pastes or spent filter elements—by enclosing the residues in a vapor-sealed enclosure, passing a gradual flow of air over said residues at ambient to moderately elevated temperature to form a solvent-rich air phase; conducting this solvent-rich air phase to the vent scrubber commonly found in dry cleaning establishments and in that vent scrubber removing the solvent from the solvent-rich air phase and recovering the solvent in the vent scrubber.

In another aspect, this invention provides the contacting enclosure for carrying out the ambient to moderately elevated temperature contacting of the residue with the air stream.

DETAILED DESCRIPTION OF THE INVENTION

Brief Descriptions of the Invention

The invention will be described with reference being made to the appended drawings in which.

DESCRIPTION OF PREFERRED EMBODIMENTS

Figure 1:
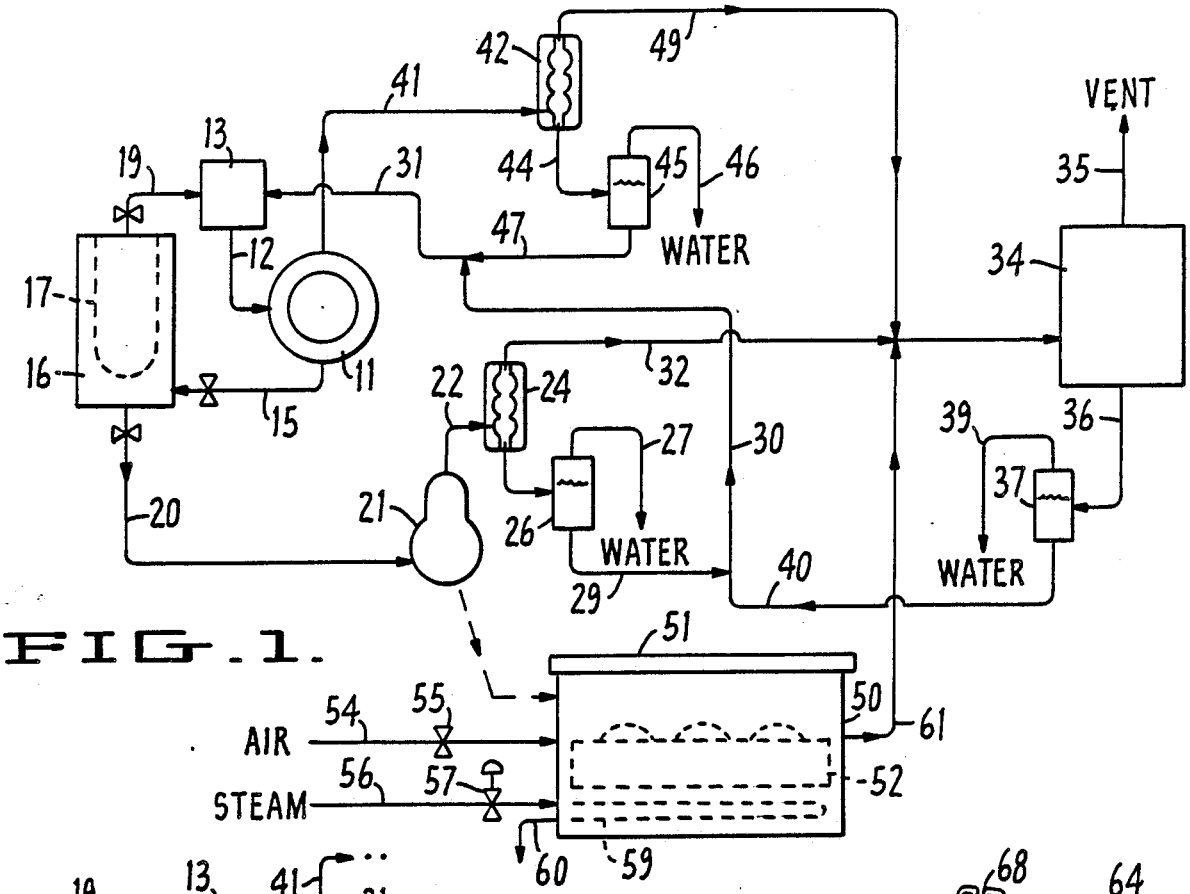
FIG. 1 is a diagram of solvent flow in a typical dry cleaning plant, illustrating one application of the present invention.

Turning to FIG. 1, a dry cleaning machine 11 is shown into which soiled fabric, clothes, etc. are added. Dry cleaning solvent from tank 13 is added to machine 11 via line 12. Typical dry cleaning solvents include perchloroethylene, trichlorofluoroethylene, and trichlorofluoromethylene, and mixtures thereof. Very typically, the solvent will contain 0.1–2.0% especially 0.75 to 1.5% of a detergent such as the material marketed by Streets under the trade name Staticol. Such solvent, during contact with the soiled clothes, etc., picks up soil, including moisture (water), grease and oils, dyes, fatty acids, soaps, solids such as dirt and sand, and the like. The soiled solvent is continuously removed from machine 11 via valved line 15 to filter 16. In filter 16 the soiled solvent passes through filter bag 17, which is covered with various filter aids to facilitate the deposit of soil on the filter. Such filter aids can include silica, diatomaceous earth, clays, carbon black (known in the trade as "Darco"), and the like. Clean solvent is collected on the other side of the bag and removed via valved line 19 for recycle to tank 13. The pressure drop across bag 17 is watched. When it exceeds an acceptable level, it is an indication that the bag is becoming overloaded with soil. Line 15 is closed and the filter bag is backwashed such as by flowing solvent back through the filter while agitating the filter contents by means not shown. This gives rise to a soil and filter aid laden solvent which is removed from filter 16 via valved line 20 to flasher 21, where an overhead fraction containing solvent and water is taken off via line 22 and condensed in condensor 24. The liquid condensate is passed through line 25 to phase separator 26, where a light water phase is taken off for discard via line 27 and a heavy solvent phase is taken off through line 29 for recycle to tank 13 via lines 40, 30 and 31. A vapor phase containing residual amounts of dry cleaning solvent is removed from condensor 24 and passed through line 32 to vent scrubber 34. Vent scrubber 34 is present in all modern cleaning plants, and consists of a system for removing the last remaining traces of solvent from the air going to vent 35. Such scrubbers work using various principles—including condensation or adsorption and desorption of solvent molecules on beds of activated carbon and the like. A typical vent scrubber is the unit marketed by Hoyt under the trade name Sniff-O-Miser. Typically, such units have limited capacity for solvent such as up to 2, 4, or 8 gallons per day. The solvent removed from the vent in scrubber 34 is recovered therein either continuously or in batch and removed via line 36 to separator 37, where again water is taken off via line 39 and halohydrocarbon is taken off via line 40 for recycle via lines 30 and 31.

Another vent stream taken directly from machine 11 by line 41 is treated similarly first to remove and recover solvent for recycle using condensor 42, line 44, separator 45, line 46, and line 47. The vapor phase from condensor 42 goes via line 49 and line 32 to scrubber 34, as well.

The foregoing system generates, in flasher 21, a bottom residue which is rich in solids but which also contains a large proportion of solvent. This material can be "cooked" in the flasher reboiler to try to drive off as much solvent as possible. However, this cooking, even at best yields a product containing about 50% by weight of solvent. This bottoms product is removed from flasher 21 and manually transferred (as shown by the dashed line) to aftercooker enclosure 50. Aftercooker enclosure 50 carries a lid 51 which sealably engages the open end of 50 so as to create a vapor-tight enclosure when closed. The residue 52 is placed in a suitable tray or similar receptacle 62 and lid 51 is sealably closed. A stream of air is passed into enclosure 50 via line 54. Line 54 carries a valve 55 so that the flow can be regulated. An outflow stream of air exits enclosure 50 via line 61 for conduction to vent scrubber 34. In practice, scrubber 34 presents a small negative pressure, such as from 0 psig to about −1 psig so that line 61 pulls a small vacuum on enclosure 50. In this setting line 54 can be merely an aperture and valve 55 can be a damper or the like regulating the flow of air drawn into enclosure 50 by means of the vacuum drawn through line 61. The flow of air through enclosure 50 is a gradual flow. That is it is not a high velocity flow that drives or knocks solvent from the residue. Rather it is a flow having an average velocity of less than about 10 feet/sec and preferably less than about 1 feet/sec, more preferably less than about 1 or 2 feet/min. which relies on simple evaporation to remove solvent. Enclosure 50 is equipped with a device for varying its internal temperature. This device is shown in FIG. 1 as a stream line 56, which passes a controlled flow of steam through regulation 57 to coil 59 and then to exit line 60. This steam coil can raise the temperature inside the enclosure from ambient (or in some cases, a few degrees below ambient because of evaporative cooling) to up to about 160° F. or 175° F. or so. In usual operation, the temperature is begun at ambient temperature and gradually raised over a period of several days to 125°–140° F. maximum. These moderate temperatures are advantageous for several reasons. For one, they minimize any breakdown of the halohydrocarbon. For another, they are energy efficient such that minimal heat is lost from the device in use. For another, they eliminate operation burn hazards. Other means for heating, such as electric heating can be employed if desired. The after cooker can also be used at higher temperatures such as up to 175° F., if desired. These higher temperatures can serve to more quickly remove solvent or to more thoroughly remove final traces of solvent.

The flow of air through enclosure 50 and the temperature of enclosure 50 are each regulated to take off an amount of halohydrocarbon which does not exceed the amount which can be recovered in scrubber 34. As previously noted, scrubber 34 may have a nominal capacity of 2 to 8 or more gallons of solvent per day.

The residue is held in the enclosure for an extended period, such as from about 3 days to about 30 days to reduce its solvent content to below about 10% by weight, preferably to below about 5% by weight, more preferably to below about 1% by weight.

A number of factors come into play in determining the length of time employed to "cook down" a residue. One factor is temperature. As a general and approximate rule, a 40° F. increase in temperature doubles the rate at which solvent is removed. At about 100°–115° F., solvent content has a half life of about 3 days (a day is 6–8 hours) in the unit of this invention. Thus, a residue containing 50% solvent would have its solvent content reduced to about 25% after 3 days or so, at 110° F. or to about 25% after 1–2 days or so at 150° F. In this much time again, the content would drop to 10–15%, etc. Using this "half life" one can see that at 110° F., a 50% starting material will be to below 1% in about 18 days and at 150° F., this level can be achieved in about 9 days. All of the numbers are approximate and depend upon numerous variables but are a good estimate of the excellent results which may be achieved with the present invention.

Figure 2:
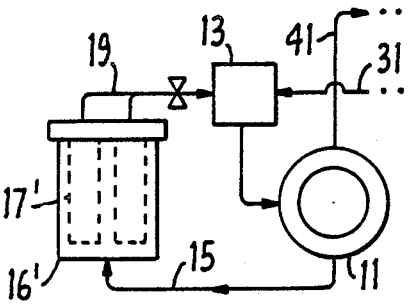
FIG. 2 is a partial flow diagram illustrating another application of this invention.

Turning to FIG. 2, an alternate design for the dry cleaning filter system is shown in which cartridge filters 17' held within holder 16' replace the bag filter used in the system depicted in FIG. 1. The other elements shown in FIG. 2 are the same as those shown in FIG. 1. With cartridge filters, when they become overloaded, conventionally they are merely drained in place and then discarded, causing considerable loss of solvent. In accord with the present invention, they are removed and placed in an aftercooker of this invention.

Figure 3:
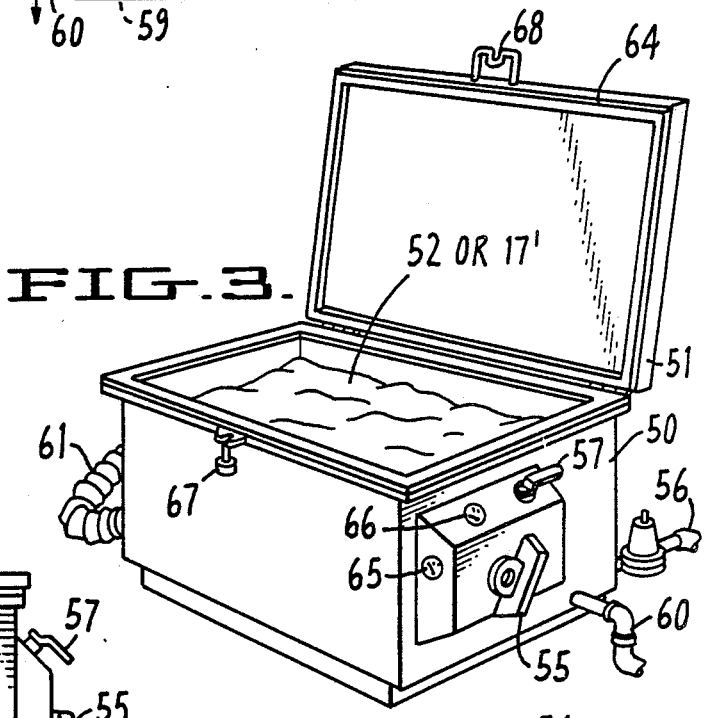
FIG. 3 is a perspective view of a residue enclosure provided by the present invention.
Figure 4:
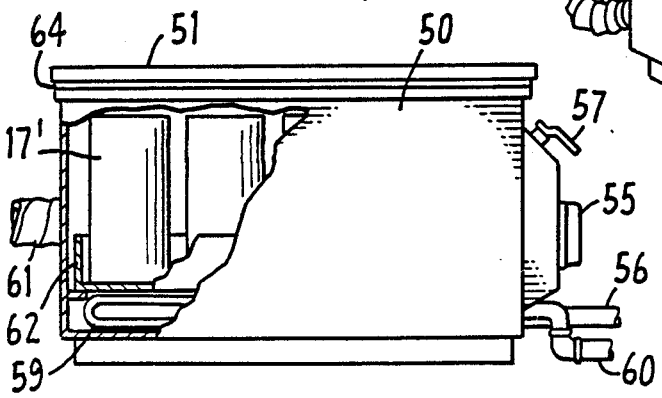
FIG. 4 is a partially cut away side view of the enclosure of FIG. 3.

Turning to FIGS. 3 and 4, a more detailed perspective view and a partially cut away side view of an aftercooker of this invention are shown. This aftercooker includes an enclosure 50, carrying a residue tray 62 into which the residue—either in the form of solids 52 or used filter cartridges 17'—is placed. The size of enclosure 50 should be selected to conveniently accomodate the residue. Typically the filter cartridges are about 13–15 inches long and a very convenient size for enclosure 50 and the residue tray 62 is such as to accomodate, 6, 8, 12, 20, or 24 such cartridges. The aftercooker includes a sealable lid 51 which is shown carrying a gasket 64 which achieves the desired seal. Lid 51 is held closed by latch 67/68. This latch is shown in the form of a screw latch but other functionally equivalent closure devices can be employed. A controlled flow of air is admitted to enclosure 50 through damper valve 55. Valve 55 allows the amount of air to be varied. The flow of air is exhausted from the enclosure through line 61 to the vent scrubber which is not shown in these figures but which is described hereinabove with reference to FIG. 1.

A flow of steam is admitted to heating coil 59. This flow of steam is inputted through regulated line 56 and exhausted through return line 60. Control valve 57 controls the amount or pressure of steam admitted to the coil 52 within the enclosure and thus the temperature achieved in the enclosure. The embodiment shown in these figures employs a manually actuated valve 57. It will be appreciated that an automatic valve that is controlled to give a programmed flow of steam and thus to provide an ever-increasing temperature during the aftercooker cycle could also be employed, if desired. The temperature within the enclosure and the steam pressure are indicated on guages 65 and 66.

Figure 5:
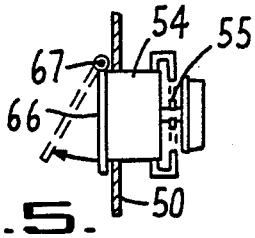
FIG. 5 is a detail of an air admission valve which can be used in an enclosure provided by the present invention.

Turning now to FIG. 5, a specialized form of the air inlet is show. This inlet includes the wall of enclosure 50, and air inlet line 54 in which is inserted damper valve 55. Line 54 also communicates with flapper valve 69 which is pivotably attached to hinge 70. Flapper valve 69 is held in a normally closed position by gravity but can pivot open by means of an air flow into enclosure 50. When no air is flowing the flapper valve closes. This prevents backflow of vapor into the environment and allows the aftercooker to be sealed during periods when the vent scrubber is shut off, such as in the evenings and on holidays when the dry cleaning establishment may not be operating.

This invention will be further described by means of the following Examples. This example is provided for purposes of illustration and is not to be construed as a limitation on the scope of the invention which is instead defined by the appended claims.

EXAMPLE I

A dry cleaning plant such as is shown in FIG. 1 is operated until bag filters 17 begin to show a significant pressure drop. The filters are backwashed and the backwash liquid is collected and flashed. The flasher residue is heated in place to drive off solvent as thoroughly as possible. This yields 84.5 pounds of a sludge-like residue which is heavily loaded with perchloroethylene solvent. This solid residue is transferred to an aftercooker as shown in FIGS. 3 and 4. The temperature is initially 70°–85° F. and is gradually raised to 118° F. The aftercooker is operated during normal work hours (about 8 hours per day) and allowed to cool during off hours. The weight of the residue was monitored periodically. The results are shown in Table I.

TABLE I

| Day | Temp., °F. | Net Wt. Residue, Lbs. | Solvent Recovery, Lbs. | Weight Change, % | Estimated*** Solvent Remaining % |
|---|---|---|---|---|---|
| 0 | 110 | 84.5 | 0 | 0 | 40 |
| 2 | 115 | 70.5 | 14.0 | 16.6 | 23.4 |
| 3 | 115 | 68.0 | 16.5 | 19.5 | 20.5 |
| 7* | 117 | 59.25 | 25.25 | 29.88 | 10.1 |
| 10** | 118 | 55.5 | 29.0 | 34.3 | 5.7 |
| 11 | 118 | 53.75 | 30.75 | 35.2 | 4.8 |

TABLE I-continued

| Day | Temp., °F. | Net Wt. Residue, Lbs. | Solvent Recovery, Lbs. | Weight Change, % | Estimated*** Solvent Remaining % |
|---|---|---|---|---|---|
| 15 | 120 | 52.25 | 32.25 | 38.2 | 1.8 |

*Does not include 2 weekend days when shut down.
**Does not include 4 weekend days when shut down.
***Based on exponential plot straight line.

These results demonstrate that the aftercooker of the invention can significantly reduce the solvent content of dry cleaning residues and can reduce solvent content to 1% level or less. If a higher temperature had been employed a faster cook down would have resulted. The appearance of the residue as it is removed from the aftercooker also reflects this reduction. The product is a dry powder having minimal odor of perchloroethylene. The material as added was a solvent-saturated paste.

It should be noted that the material treated in this example was very well dried before it was placed in the aftercooker. Very typically this residue could have weighed as much as 100 to 110 lbs. with the additional weight being in the form of extra solvent. With such a waste product the waste aftercooker of this invention could exhibit even better results, in terms of weight of solvent recovered.

EXAMPLE II

The device and process of the invention as shown in Example I is also used to remove solvent from spent cartridges. Ten conventional "Puritan" 14½"×7½" cartridges are drained for five days and placed in the cooker of Example I. They have a total weight of 240 lbs. The results of an initial cook down period are given in Table II and demonstrate that the aftercooker is effective in this setting as well.

TABLE II

| Day | Temp., °F. | Net Wt. Residue, Lbs. | Solvent Recovery, Lbs. | Weight Change, % |
|---|---|---|---|---|
| 0 | 120 | 240 | 0 | |
| 6 hr | 120 | 221.5 | 18.5 | 7.7 |
| 2 | 118 | 209 | 31 | 12.9 |
| 3 | 110 | 193 | 47 | 19.6 |
| 4* | 110 | 179.5 | 60.5 | 25.2 |
| 5 | 118 | 166.5 | 73.5 | 30.6 |
| 6 | 125 | 155 | 85 | 35.4 |
| 7 | 126 | 146.5 | 93.5 | 39 |
| 8** | 130 | 135 | 105 | 43.7 |
| 9 | 130 | 126.5 | 113.5 | 47.3 |
| 10 | 130 | 121 | 119 | 49.6 |

*Does not include 2 weekend days when shut down.
**Does not include 4 weekend days when shut down.

What is claimed as my invention is:

1. A dry cleaning solvent recovery system for separating contaminant-laden halohydrocarbon dry cleaning fluid into reusable clean dry cleaning solvent and solvent free solid residue comprising a dry cleaning machine employing halohydrocarbon dry cleaning fluid and capable of generating a spent liquid comprising solid soil and filter aid in said halohydrocarbon dry cleaning fluid, said machine having a vent and a vent scrubber capable of removing and recovering dry cleaning solvent vapors from said vent, means for recovering clean dry cleaning solvent from said spent liquid and generating a high solvent content residue phase comprising a mixture of soil and filter aid together with dry cleaning solvent, means for transferring said residue phase to a dry cleaning residue aftercooker device comprising a vapor-sealed enclosure having a vapor sealable opening adapted for receiving into said enclosure the high solvent-content dry cleaning residue phase, means for controlling the temperature within said enclosure to within the range of 65° F. to 175° F. means for admitting a flow of air into said enclosure into contact with said dry cleaning residue, and means for withdrawing a flow of solvent-vapor-enriched air from said enclosure and conducting said solvent-vapor-enriched air to said vent scrubber system present in said dry cleaning machine.

2. The recovery system device of claim 1 wherein such means for admitting a flow of air includes a one-way valve restricting the flow of air outward from within said enclosure.

3. The recovery system device of claim 2 wherein said means for admitting a flow of air includes a baffle regulator.

4. The recovery system device of claim 2 additionally comprising means for measuring and indicating the temperature within said enclosure.

5. The recovery system device of claim 1 wherein said means for controlling temperature includes a low pressure stream heater.

6. The recovery system device of claim 1 additionally comprising an open container adapted to hold the residue within said enclosure.

7. The recovery system device of claim 6 wherein said open container is a tray adapted to hold a solvent-containing paste of particulate solid residue.

8. The recovery system device of claim 6 wherein said open container is adapted to hold solvent-containing residue-laden disposable filter elements.

* * * * *